US008683633B2

(12) United States Patent
Cao

(10) Patent No.: US 8,683,633 B2
(45) Date of Patent: Apr. 1, 2014

(54) MATTRESS WITH CONCEALED MASSAGE UNITS

(76) Inventor: Zheng Cao, McKinney, TX (US)

( * ) Notice: Subject to any disclaimer, the term of this patent is extended or adjusted under 35 U.S.C. 154(b) by 0 days.

(21) Appl. No.: 13/590,200

(22) Filed: Aug. 21, 2012

(65) Prior Publication Data

US 2013/0042413 A1 Feb. 21, 2013

Related U.S. Application Data

(60) Provisional application No. 61/525,832, filed on Aug. 21, 2011.

(51) Int. Cl.
*A47C 27/10* (2006.01)

(52) U.S. Cl.
USPC ..... 5/713; 5/933

(58) Field of Classification Search
USPC ..... 5/933, 944, 710–713, 655.3, 654
See application file for complete search history.

(56) References Cited

U.S. PATENT DOCUMENTS

| | | | | |
|---|---|---|---|---|
| 5,267,364 | A * | 12/1993 | Volk | 5/713 |
| 5,836,027 | A * | 11/1998 | Leventhal et al. | 5/706 |
| 6,178,577 | B1 | 1/2001 | Chien-Chuan | |
| D536,897 | S | 2/2007 | Pupak | |
| 7,434,283 | B2 * | 10/2008 | Wilkinson et al. | 5/713 |
| 7,996,940 | B1 * | 8/2011 | Dahm et al. | 5/654 |
| 2007/0185421 | A1 | 8/2007 | Wu | |
| 2008/0201858 | A1 | 8/2008 | Caminade | |
| 2009/0100605 | A1 | 4/2009 | Caminade | |

* cited by examiner

*Primary Examiner* — Fredrick Conley
(74) *Attorney, Agent, or Firm* — Adam Biggs

(57) ABSTRACT

A mattress with built-in massage capabilities that is arranged so the mattress can be used as a standard sleep surface when the massage function is idle. In standard sleep mode a user will not notice the massage aspects of the mattress. Massage is performed by air pumps and air bags controlled to simulate various massage protocols such as wave, stretching, kneading, and percussion.

9 Claims, 5 Drawing Sheets

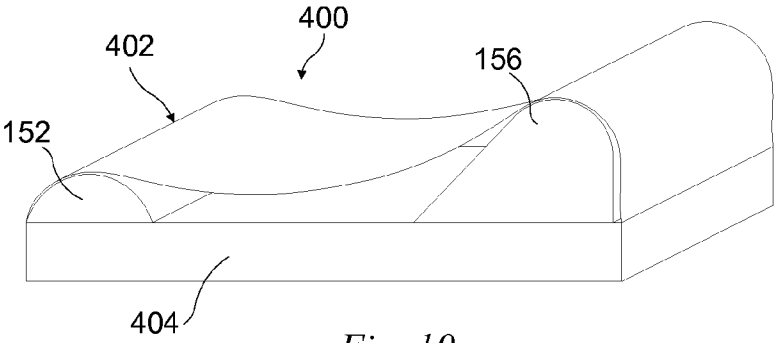
*Fig. 10*
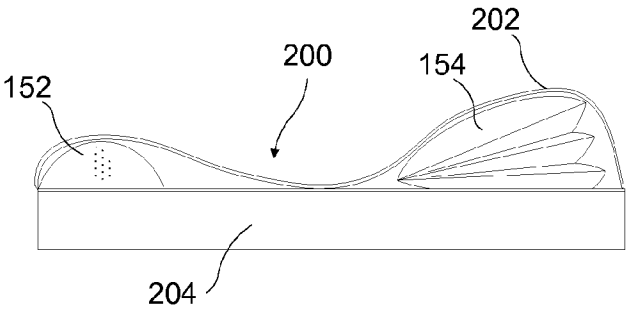
*Fig. 9*
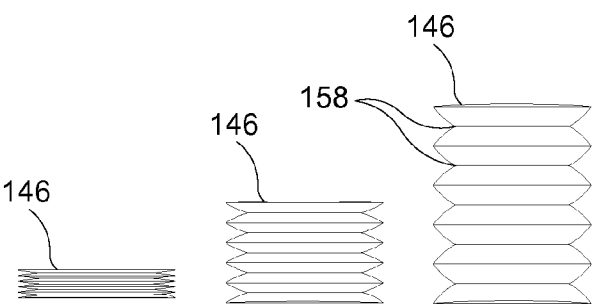
*Fig. 12c*
*Fig. 12b*
*Fig. 12a*
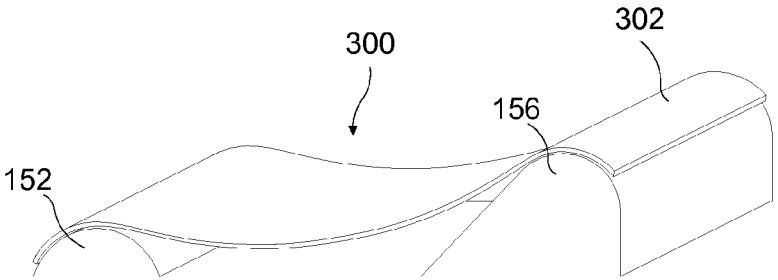
*Fig. 11*

MATTRESS WITH CONCEALED MASSAGE UNITS

CROSS-REFERENCE TO RELATED APPLICATION

This application claims priority to U.S. Provisional Patent Application No. 61/525,832 filed Aug. 21, 2011 the disclosure of which is incorporated herein by reference.

BACKGROUND

The present invention relates to a mattress, and more particularly to a mattress with multiple massage units concealed within, so that the one mattress is functional to massage users only when needed. When not being used for massage, the mattress functions as a regular mattress for sleeping.

In today's modern, sedentary life style, people are spending more time sitting in their offices, or at desks, working on computers or performing other tedious work. Hours of sitting can cause sore, stiff limbs and back pain. Massage is a helpful remedy to relieve such maladies. However, as work days lengthen and budgets tighten, the time and resources required for receiving a massage have become increasingly scarce, leading a general reduction in feelings of health and well-being.

The need for massage to relieve muscle tension and soreness is increasing. Many types of massage devices have been developed and are marketed to enable general consumers to more conveniently treat their sore, stiff limbs and back pain at home. Among these devices, there are large-sized massage lounges and small-sized massage rods.

Some massage mattresses and mats have been constructed by offering a conventional mattress configured with one or more massage units that are fixedly mounted. In one configuration, compression bags attached to the exterior top surface of a pad inflate and protrude into the air around a user's limbs. Such compression bags may offer massage benefits but are not conducive to normal sleep. For example, for such a pad to function, the pad has to be above the mattress surface and cannot be covered with a standard mattress sheet. These pads are not conducive to the long term comfort required for restful hours of sleep.

Another type of mattress and pad has been constructed of hard rollers that run under the mattress or pad covering. While perhaps useful for short periods, the hard, protruding rollers do not offer a long term solution to massage that can performed while one is asleep. Some users have reported bruising and inability to sleep due to the intrusive design of the rollers.

A third type of mattress has been configured by combining one or more vibrating massage units to the mattress or bed frame. This solution does little to provide actual massage relief. In addition to the ineffectiveness of the massage, the constant buzzing and vibration can hinder restful sleep.

A massage mattress, as described herein, may be the most desirable since a user needs only to lie on the mattress to have the whole body well massaged. Additional time traveling to and receiving a massage is not needed when a person can merge that treatment with the time spent sleeping in his own bed. The massage mattress described is also well suited for the aged and sick since the massage movements disclosed can help reduce the probability of bedsores by automatically moving pressure points and increasing circulation.

SUMMARY

In one exemplary embodiment, a massage mattress is disclosed with a standard sleep function which is capable of selectively offering a variety of massage protocols.

In another exemplary embodiment, a combination of massage components disclosed is combined to modify existing mattress to add massage capabilities.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 9 is a side view of the massage mattress according to an exemplary embodiment with a cover partially cut away.

FIG. 10 is a front isometric view of the massage mattress according to an exemplary embodiment with a cover partially cut away.

FIG. 11 is a front isometric view of the massage mattress according to an exemplary embodiment with a cover partially cut away.

FIGS. 12*a* through 12*c* are side views of a massage effector according to an exemplary embodiment.

DETAILED DESCRIPTION

This disclosure describes a novel mattress design which incorporates concealed massage units. The novel mattress design has strategically placed, and specifically shaped air bags that are inflated and deflated to achieve a desired massage effect. The novel mattress design allows for a standard mattress that is used for sleeping to simultaneously be used to obtain one or more therapeutic massage protocols. The novel mattress design has a massage engine that includes a controller that operates one or more massage effectors. The controller operates pumps and various valves connected to pneumatic tubing or other motorized parts. In a pneumatic embodiment, tubing connects to inflatable bags which are situated to simulate various massage protocols. In a mechanical embodiment, inflatable bags are used to situate a mechanical massage effector to carry out massage protocols. In particular, the massage engine can create a slow wave effect to variously stretch large body parts. Specific body parts can be moved by raising and lowering, or inflating and deflating, certain bags. A percussion massage protocol can be achieved by the massage engine, targeted for specific body parts. Additionally, a kneading type of massage protocol is obtained by using certain air bag configurations.

Figure 1:
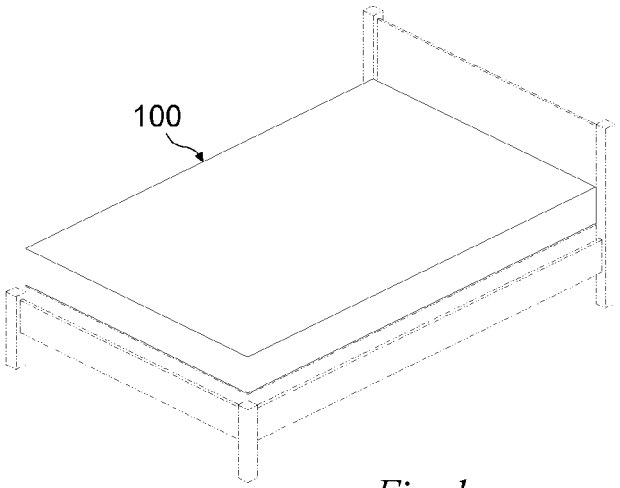
FIG. 1 is a front isometric view of the massage mattress according to an exemplary embodiment.

Referring to FIG. 1, a massage mattress 100 is shown according to an exemplary embodiment in a front isometric view. In this exemplary embodiment the massage mattress would take the place of a user's standard sleeping mattress. When the massage engine is off, the massage components would not be detectable by the user.

Figure 2:
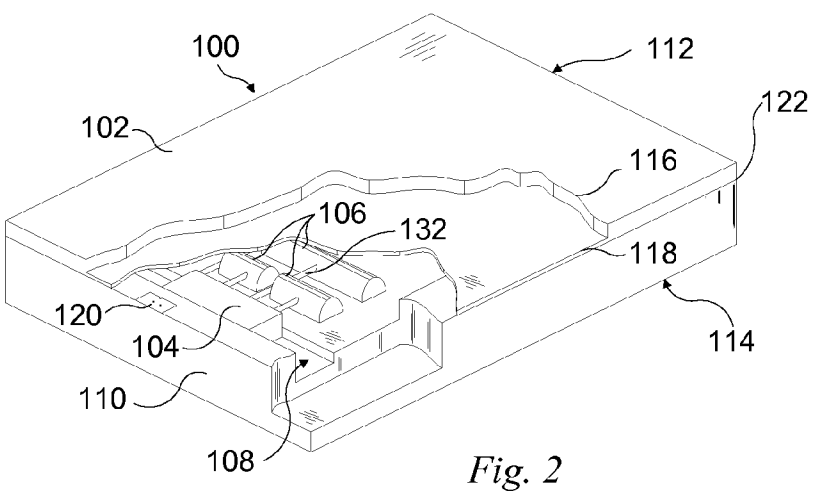
FIG. 2 is a front isometric view of the massage mattress according to an exemplary embodiment with several layers partially cut away.

Referring now to FIG. 2, a front isometric view of massage mattress 100 according to an exemplary embodiment is shown with several layers partially cut away. Mattress 100 is generally enclosed in a fabric mattress cover 102. Inside the cover 102 are enclosed a control system 104 which is in operable communication with massage effectors 106. The control system 104 and massage effectors 106 generally reside in a cavity 108, and are jointly referred to as a massage engine 124, shown in FIG. 4. Communication between the control system 104 and massage effectors includes pneumatic and hydraulic tubing 132. Cavity 108 is created by removal of material from a core layer 110. The cover 102 is preferably comprised of an upper cover 112 and lower cover 114. The upper and lower covers are removable connected with a zipper, hook and loop fastener tape, or other methods know in the art. Removal of the upper cover 112 may facilitate construction of the mattress and maintenance, as needed. A resilient layer 116 covers the massage engine 124 and may be attached to core 110 with attachment pad 120. Attachment pads 120 are used as needed to maintain the position of the layer 116 with respect to core 110, and more particularly, with respect to the massage effectors 106. An additional layer of stretchable fabric 118 may be adhered to the bottom of resilient layer 116 to increase the wear resistance and reduce the friction between layer 116 and the effectors 106. Layer 116 and core 110 are both preferably constructed of a resilient foam material, such as memory foam, but may be comprised of other open or closed cell foam or padding. The layer 116 and core 110 may be constructed from dissimilar materials as well.

Figure 3:
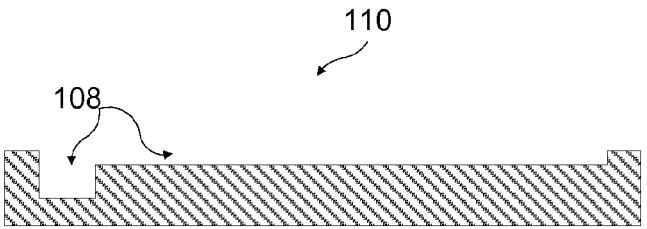
FIG. 3 is a longitudinal cross-sectional view of a component of the massage mattress according to an exemplary embodiment.

Referring now to FIG. 3, a longitudinal cross-sectional view of the core 110 is shown. The cavity 108 is created to accommodate the massage engine 124, shown in FIG. 4. In the embodiment shown in FIG. 2, core 110 is manufactured from a single piece of foam. In another embodiment, core 110 may be assembled from various pieces of foam to obtain specific properties and to modify the manufacturing process.

Figure 4:
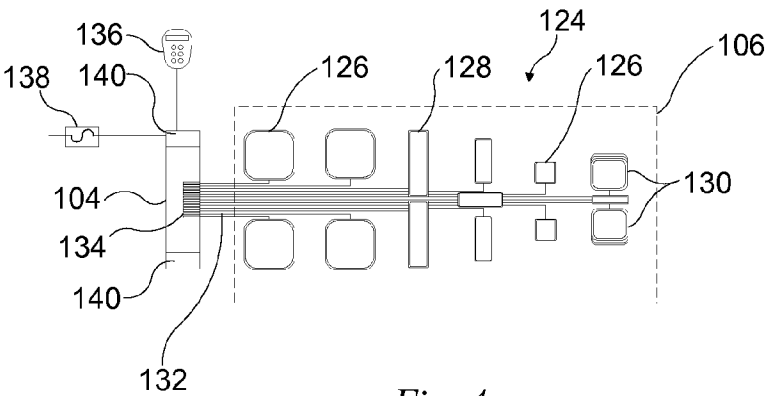
FIG. 4 is a top view of a massage engine for the massage mattress according to an exemplary embodiment.

Referring now to FIG. 4, a top view of massage engine 124 for massage mattress 100 is shown. Massage engine 124 is generally comprised of a control system 104 operably connected to massage effectors 106 using connections 132. Connections 132 may be hoses, tubes, or control wires. Control system 104 is generally comprised of a controller 136 which is connected to one or more pumps 140, valves 134, and power source 138. The pumps are preferably air pumps but hydraulic pumps may also be used by adding additional components, such as a reservoir, as needed. In some embodiments, the motive force for the massage effectors may be distributed throughout massage engine 124. As shown in FIG. 4, various types of massage effectors may be connected to the control system, including square air bags 126, rectangular air bags 128, and small asymmetrical air bags 130. The inflatable bags, whether filled with air or another fluid, are preferably constructed from fluid tight, flexible materials, such as, but not limited to, thermoplastic polyurethane, polyurethane, urethane, polyvinyl chloride, rubber, silicon, polyethylene, nylon, nylon 6-6, TEFLON, polyester, or polyamide. Although representative massage effectors are shown, additional shapes and configuration may be used and are contemplated.

Figure 5:
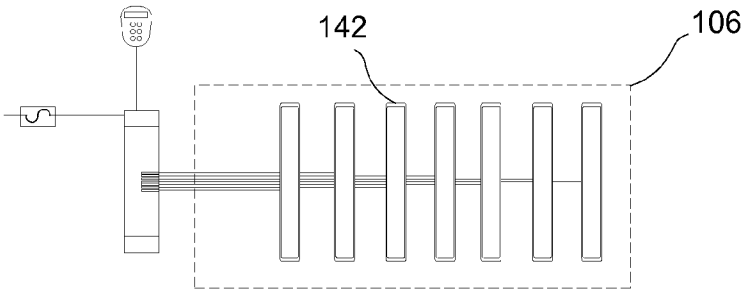
FIG. 5 is a top view of a massage engine for the massage mattress according to an exemplary embodiment.

Referring now to FIG. 5, a top view of a massage engine is shown with massage effectors 106 comprised of lateral, narrow inflatable bags 142, which are generally cylindrical in shape and reach between the sides of the massage engine. The arrangement using bags 142 can be used to simulate a massage protocol that feels like a travelling wave.

Figure 6:
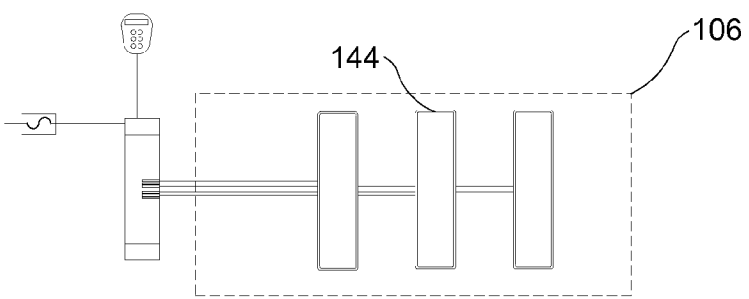
FIG. 6 is a top view of a massage engine for the massage mattress according to an exemplary embodiment.

Referring now to FIG. 6, a top view of a massage engine is shown with massage effectors 106 comprised of lateral, wide inflatable bags 144, which are generally cylindrical in shape and reach between the sides of the massage engine. The arrangement using bags 144 can be used to simulate a massage protocol that feels like a bobbing wave.

Figure 7:
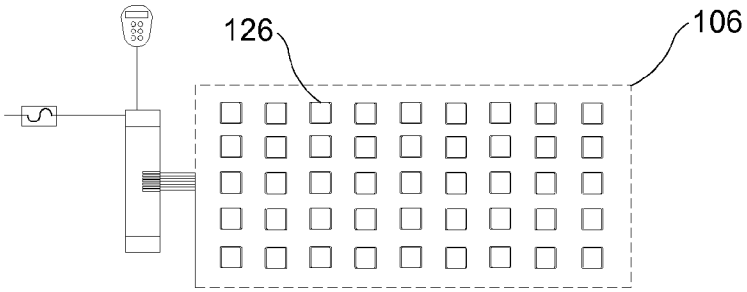
FIG. 7 is a top view of a massage engine for the massage mattress according to an exemplary embodiment.

Referring now to FIG. 7, a top view of a massage engine is shown with massage effectors 106 comprised of small inflatable bags 126, which are generally square in shape and are arranged to provide a percussive massage protocol to various user body parts.

Figure 8:
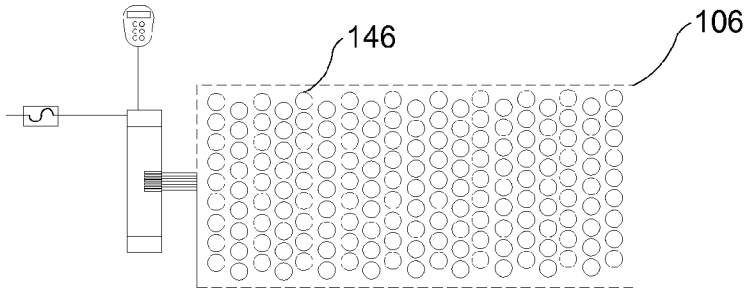
FIG. 8 is a top view of a massage engine for the massage mattress according to an exemplary embodiment.

Referring now to FIG. 8, a top view of a massage engine is shown with massage effectors 106 comprised of a plurality of circular inflatable bags 146. Circular bags 146 may be considered air springs as they are generally circular in shape and extend upwards to form a cylinder shape when extended. This arrangement of bags 146 may be used to provide a percussive massage and may be used to change the firmness and height of the entire mattress or of various individual points or regions. In one embodiment the air springs 146 are encased in a layer of foam through which holes have been created to accommodate and restrain lateral movement of the springs as they are inflated.

Referring now to FIG. 9, a side view of the massage mattress 200 according to an exemplary embodiment is shown with a cover 202 partially cut away. In between the cover 202 and the mattress base 204 are located two large air bags 152 and 154. Lateral leg air bag 152 and asymmetrical, pleated air bag 154 are arranged to provide a user with adjustable support and massage when inflated. When bags 152 and 154 are deflated, massage mattress 200 is usable a standard mattress without any discomfort to the user created by the air bags 152 and 154.

Referring now to FIG. 10, a front isometric of a massage mattress 400 is shown with a cover partially cut away. Mattress topper 402 contains air bags 152 and 156 which may be removed from mattress base 404 for sleeping. Lateral leg air bag 152 and lateral torso-support air bag 156 may have cross-sectional shapes other than those shown. Other cross-sectional shapes may include circular, oval, triangular, square, and the like. Mattress topper 402 may provide a user with adjustable, removable support and massage when inflated.

Referring now to FIG. 11, a front isometric of a massage mattress 300 is shown with a cover partially cut away. In this configuration, the massage mattress 300 is configured by placing an existing foam mattress 302 over the top of air bags 152 and 156.

Referring now to FIGS. 12*a* through 12*c*, inflatable bags, or air springs, as described in FIG. 8, are shown in various stages of inflation. In FIG. 12*a*, air spring 146 is shown completely deflated, making it essentially flat. As air is pumped into the air spring 146, it expands as shown in FIG. 12*b*. When fully extended, air spring 146 may appear as shown in FIG. 12*c*. Pleats 158 allow the air spring 146 to expand to many times its deflated height. The material used to construct the air springs 146 is generally non-elastic, such that the expansion of the air bag is provided for by the pleats 158 rather than by stretching and deformation of the air bag material.

Figure 15:
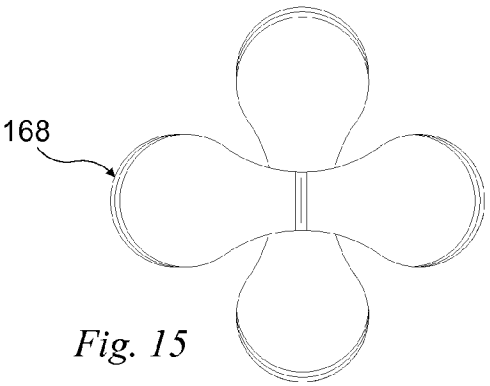
FIG. 15 is a top view of a massage effector according to an exemplary embodiment.
Figure 16:
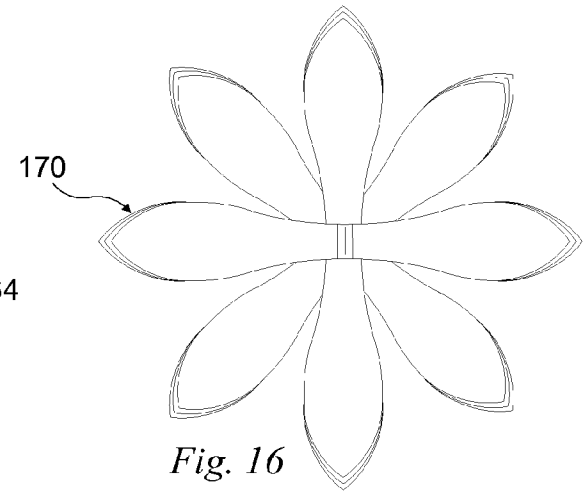
FIG. 16 is a top view of a massage effector according to an exemplary embodiment.
Figure 14A:
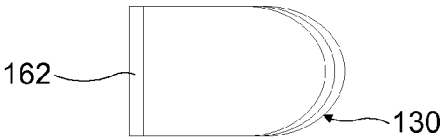
FIG. 14*a* is a top view of a massage effector according to an exemplary embodiment.
Figure 14B:
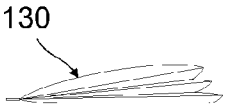
FIGS. 14*b* and 14*c* are side views of a massage effector according to an exemplary embodiment.
Figure 14C:
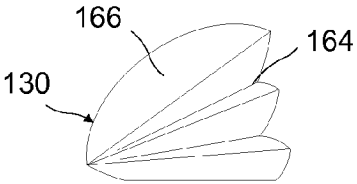
Figure 13A:
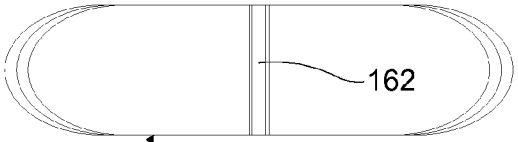
FIG. 13*a* is a top view of a massage effector according to an exemplary embodiment.
Figure 13B:
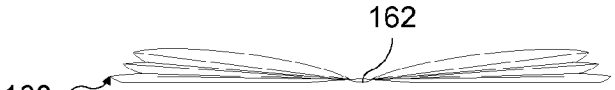
FIGS. 13*b* and 13*c* are side views of a massage effector according to an exemplary embodiment.
Figure 13C:
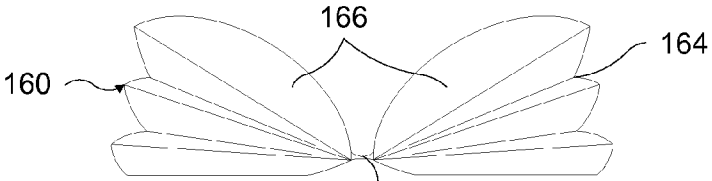

Referring now to FIGS. 13*a* through 16, various inflatable massage effectors are shown. FIG. 13*a* shows the top of an air bag 160 which is arranged as a double, asymmetrical pleated bag. The two sides of air bag 160 rotate upward about central seam 162. FIG. 13*b* is a side view of the air bag 160 in a deflated state. FIG. 13*c* is a side view of the air bag 160 in an inflated state. Pleats 164 allow the two halves of the air bag to open while being constrained in the center by seem 162. Pressure surfaces 166 come upwards and towards each other allowing this air bag to create a massage feeling of compression. FIGS. 14*a*, 14*b*, and 14*c* show a single asymmetrical pleated bag from the top, from the side, deflated, and from the side, inflated, respectively. FIGS. 15 and 16 show two additional embodiments of asymmetrically expanding air bags that can be used to create massage pressure around a body part or region.

Figure 17:
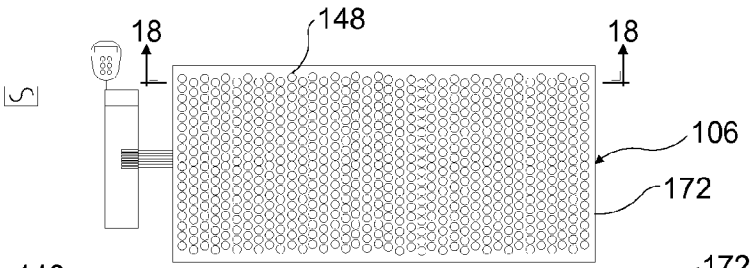
FIG. 17 is a top view of the massage mattress according to an exemplary embodiment.

Referring now to FIG. 17, a top view of the massage mattress according to an exemplary embodiment is shown. The massage effectors 106 are comprised of a plurality of cylindrical air bladders 148. The material used to construct the air bladders 148 is generally elastic, such that the expansion of the air bladders is not provided for by the inclusion of pleats but rather by stretching and deformation of the air bladder material. The air bladders are generally elongated circular balloon shapes with a length at least several times greater than a maximum diameter. Although the air bladders 148 may extend upwards somewhat when inflated, a primary function is to selectively increase and decrease the overall firmness of the mattress. A piece of foam 172 may be created with multiple holes to allow insertion of multiple air bladders 148. Air foam 172 can then achieve changes in overall firmness, height adjustment, point and regional firmness variation by selective inflation of the air bladders 148.

Figure 19:
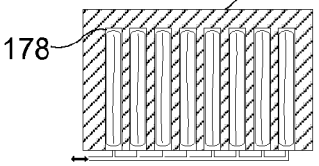
FIG. 19 is an exemplary embodiment of the configuration in FIG. 18.
Figure 18:
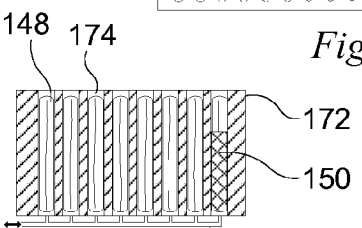
FIG. 18 is a cross-sectional view of the massage mattress taken along line 18-18 in FIG. 17.

Referring now to FIGS. 18 and 19, FIG. 18 is a partial cross-sectional view of foam 172 taken along line 18-18 in FIG. 17 and FIG. 19 shows an alternative embodiment to the embodiment shown in FIG. 18. As shown in FIG. 18, air foam 172 is created with through-holes 174 which accommodate air bladders 148. Air bladders 148 may be filled using connecting hoses 176. Alternatively, some of the through-holes 174 can be left empty to provide air movement through the air foam 172. In one embodiment, one or more of the air bladders 148 may be partially encased in a fabric sleeve 150 to modify the lateral stretching and change the air foam properties. FIG. 19 shows and embodiment for air foam 172 where partial-depth holes 178 are created to accommodate the air bladders 148, which may provide a more homogeneous sleep surface.

Figure 20:
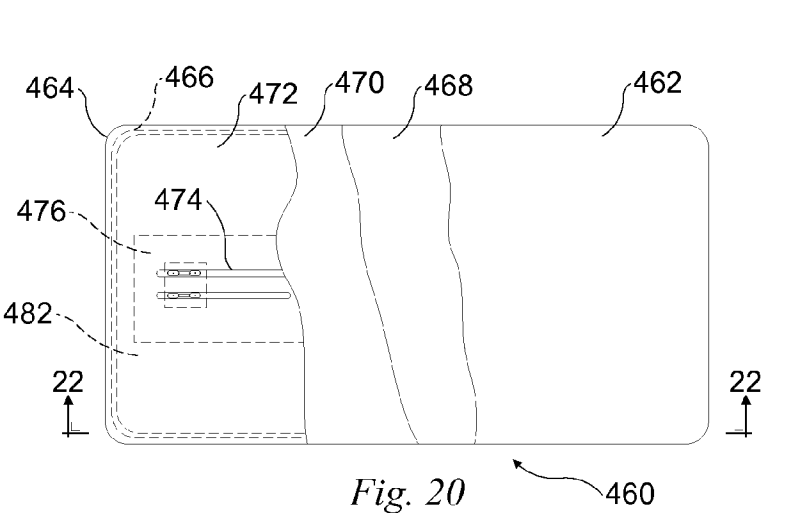
FIG. 20 is a top view of the massage mattress according to an exemplary embodiment with several layers partially cut away.

Referring now to FIG. 20, a top view of the massage mattress 460 according to an exemplary embodiment is shown with several layers partially cut away. Massage mattress 460 incorporates a novel combination of inflatable bags and mechanical massage effectors to provide a standard sleeping surface that can also provide massage characteristics. The mattress 460 has a top layer of foam 462 which covers a large upper inflatable air chamber 468 which covers the entire mattress. A mattress frame 464 provides an enclosure for various mattress components and frame 464 has an inner edge 466. From the bottom of the frame 464, the first layer of interest is an inflatable lower air chamber 482 that fills the frame 464 up to the inner edge 466. On top of the lower air chamber 482 is a rigid panel 480, shown in FIG. 21, which supports idler wheel massage units 476 and 478, shown in FIG. 21. Unit 476 is optionally placed to provide rolling massage of a user's back, while unit 478 is optionally placed to provide rolling massage of a user's lower body and legs. A semi-rigid foam board 472 covers the massage units but has wheel slots 474 which permit the idler massage wheels free passage along their tracks. A layer of wear resistant material 470, such as leather, rubber, pleather, or the like, is located between the wheels of units 476 and 478 and the upper air chamber 468 to prevent premature wear and damage to the components and layers above the wheels.

Figure 21:
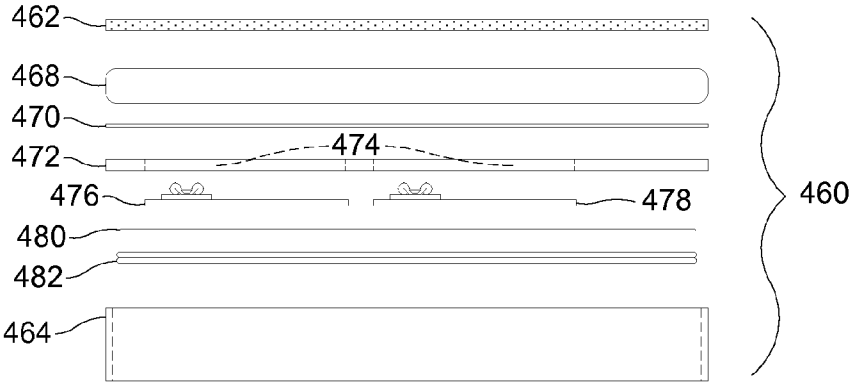
FIG. 21 is an exploded side view of the massage mattress in FIG. 20.

Referring now to FIG. 21, an exploded side view of the massage mattress 460 is shown. In this view, rigid panel 480 is shown, in addition to the layers and components described in FIG. 22.

Figure 22:
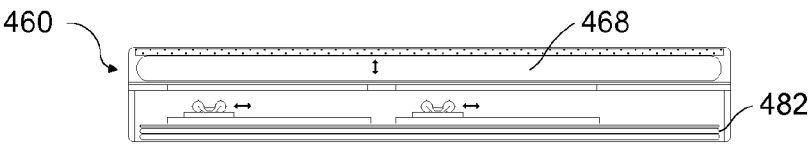
FIG. 22 is a cross-sectional view of the massage mattress taken along line 22-22 in FIG. 20.
Figure 23:
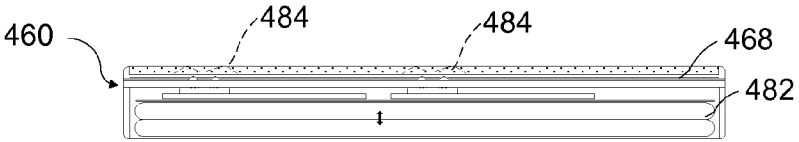
FIG. 23 is a cross-sectional view of the massage mattress taken along line 22-22 in FIG. 20.

Referring now to FIGS. 22 and 23, cross-sectional side views of the massage mattress 460 taken along line 22-22 in FIG. 20 are shown. FIG. 22 shows the mattress 460 in normal sleep mode. In sleep mode, upper air bag 468 is inflated. Lower air bag 482 is deflated, thereby lowering the massage unit wheels so they are not felt by a user. FIG. 23 shows the mattress 460 in massage mode, with lower air bag 482 inflated. When bag 482 is inflated, the wheels on the massage units protrude up through the slots 474 in foam panel 472. In order for a user to feel the massage action of the wheels, however, upper air bag 468 is deflated, allowing the foam layer 462 to press against the rolling wheels. Estimated pressure curves 484 are shown to approximate the massage compression provided by the massage wheels.

Although embodiments of the present disclosure have been described in detail, those skilled in the art should understand that they may make various changes, substitutions and alterations herein without departing from the spirit and scope of the present disclosure. Accordingly, all such changes, substitutions and alterations are intended to be included within the scope of the present disclosure as defined in the following claims. In the claims, means-plus-function clauses are intended to cover the structures described herein as performing the recited function and not only structural equivalents, but also equivalent structures.

The invention claimed is:

1. A massage mattress comprising:

an ordinary sleeping mattress, a plurality of massage effectors, and a control system controllably connected to said massage effectors, wherein said control system automatically adjusts a massage frequency of said effectors to stimulate various massage techniques, said mattress further comprising a fluid pump and valves, wherein said valves are connected to said massage effectors, and wherein said massage effectors are comprised of air bags; and wherein at least one of said air bags is an asymmetrically inflating air bag comprised of one fixed edge, circumferential pleats, and a pressure surface, wherein inflation of the asymmetrically inflating air bag causes an expansion at the pleats and rotation of the pressure surface about the fixed edge.

2. The massage mattress of claim 1 wherein a plurality of elastic bladders are inserted into holes in a foam layer of the mattress such that the selective inflation of said bladders by the control system can change the firmness of said foam layer.

3. The massage mattress of claim 1 wherein at least one of the air bags is comprised of a circular air spring that has annular pleats, which pleats allow for an increase in height without an increase in diameter.

4. A massage mattress comprising:

an ordinary sleeping mattress, a plurality of massage effectors, and a control system controllably connected to said massage effectors, wherein said control system automatically adjusts a massage frequency of said effectors to stimulate various massage techniques, and wherein a lower air bag raises an idler wheel massage assembly up to a resting surface while an upper air bag simultaneously lowers said resting surface to contact said idler wheel massage assembly.

5. A massage mattress comprising:

an ordinary sleeping mattress, a plurality of massage effectors, and a control system controllably connected to said massage effectors, wherein said control system automatically adjusts a massage frequency of said effectors to stimulate various massage techniques, said mattress further comprising a fluid pump and valves, wherein said valves are connected to said massage effectors, and wherein said massage effectors are comprised of air bags, and wherein the air bags are comprised of non-circular, asymmetrically inflating air bags comprised of one fixed edge, circumferential pleats, and a pressure surface, and wherein inflation of the air bag causes an expansion of the air bag at pleats causing the pressure surface to rotate about the fixed edge.

6. The massage mattress of claim 5 wherein a plurality of asymmetrical air bags is connected such that inflation causes the pressure surfaces to exert opposing forces along one, two, or three axes.

7. The massage mattress of claim 5 wherein inflation of air bags is controlled to simulate massage protocols from one of more of standing waves, bobbing waves, percussive massage, targeted pressure massage, selective raising and lowering of the massage mattress, and alteration of massage mattress firmness.

8. A mattress cover, comprising a plurality of air bags, with a first air bag arranged to support a user's upper torso when inflated and a second air bag arranged to support a user's lower body when inflated, wherein each air bag can be inflated individually to adjust the level of support, and wherein at least one of the plurality of air bags is an asymmetrically inflatable air bag comprised of one fixed edge, circumferential pleats, and a pressure surface, wherein inflation of the asymmetrically inflatable air bag causes an expansion at the pleats and rotation of the pressure surface about the fixed edge.

9. The massage cover of claim 8 wherein inflation of said air bags is controlled to simulate massage protocols from one of more of standing waves, bobbing waves, percussive massage, targeted pressure massage, selective raising and lowering of the massage mattress, and alteration of massage mattress firmness.

* * * * *